US005988574A

United States Patent [19]

Podgorski et al.

[11] Patent Number: 5,988,574

[45] Date of Patent: Nov. 23, 1999

[54] FURNITURE GLIDE

[76] Inventors: John Podgorski, 1125 Ash St., St. Charles, Ill. 60174; Paul A. Thorsen, 810 Hillside, Elmhurst, Ill. 60126

[21] Appl. No.: 09/144,888

[22] Filed: Sep. 1, 1998

[51] Int. Cl.[6] ..... F16M 11/24

[52] U.S. Cl. ..... 248/188.4; 248/346.11

[58] Field of Search ..... 248/188.4, 188.2, 248/188.9, 346.11

[56] References Cited

U.S. PATENT DOCUMENTS

| | | | |
|---|---|---|---|
| 287,913 | 11/1883 | Dawson et al. . | |
| 1,016,324 | 2/1912 | Dunn . | |
| 1,435,606 | 11/1922 | Henry . | |
| 2,217,996 | 10/1940 | Sasgen | 248/188.9 X |
| 2,403,338 | 7/1946 | Butler | 248/188.4 X |
| 2,728,166 | 12/1955 | Molla | 248/188.9 |
| 3,025,631 | 3/1962 | Reynolds | 248/188.9 |
| 3,144,234 | 8/1964 | Artmann . | |
| 3,455,526 | 7/1969 | Orii . | |
| 3,592,423 | 7/1971 | Mul | 248/188.4 X |
| 3,970,273 | 7/1976 | Tanner | 248/188.4 X |
| 4,576,357 | 3/1986 | Schrepfer | 248/188.2 X |
| 4,979,786 | 12/1990 | Kuraseko | 248/188.9 X |
| 5,000,416 | 3/1991 | Fantasia | 248/650 |
| 5,042,764 | 8/1991 | Carpinella et al. | 248/188.2 |
| 5,153,052 | 10/1992 | Tanaka et al. | 248/634 X |
| 5,531,413 | 7/1996 | Wolf et al. | 248/188.2 |
| 5,697,586 | 12/1997 | Lybarger | 248/188.4 |
| 5,836,556 | 11/1998 | Kim | 248/188.4 |

*Primary Examiner*—Ramon O. Ramirez
*Attorney, Agent, or Firm*—McDonell Boehnen Hulbert & Berghoff

[57] ABSTRACT

A furniture glide assembly including a threaded rod, a convex glide foot, and an retractable glide foot, wherein the furniture associated with the glide assembly is essentially immobile when the glide foot is engaged, and wherein the furniture can be easily moved when the glide foot is retracted.

11 Claims, 2 Drawing Sheets

FURNITURE GLIDE

BACKGROUND OF THE INVENTION (1) Field of the Invention

This invention concerns a furniture glide including a retractable glide cup that may be used to level and/or immobilize furniture, appliances, or any other devices or apparatus used with legs or feet.

(2) Description of the Art

Major household appliance such automatic clothes washers, clothes dryers and refrigerators, office furniture and in particular modular office furniture typically include glides which are feet that provide a mechanism for supporting, immobilizing, and for leveling the piece of furniture or appliance so that it may be used optimally even though the floor on which it is mounted may not be level. One problem that exists with glides associated with furniture and appliance is that they are designed only level and immobilize the furniture or appliance to which they are associated. As a result, it is difficult to move furniture or appliances with immobilized glides without completely lifting the furniture or appliance off the ground, by pushing instead of lifting. Thus, improperly moving appliances or furniture that is associated with furniture glides can cause the furniture glides to bend and or snap which requires the difficult and expensive replacement of the glides.

SUMMARY OF THE INVENTION

It is an object of this invention to provide a glide useful for stabilizing and leveling furniture or appliances that includes a retractable glide cup that stabilizes the furniture or appliance when engaged and that facilitates the movement of the furniture or appliance when not engaged.

Another object of this invention is a glide useful when used in association with appliances or furniture that includes a concave foot that facilitates movement of the furniture or appliances when the retractable glide cup is disengaged.

Yet another object of this invention is a furniture or appliance glide that includes a retractable glide cup that may be associated with various types of surface grippers depending upon the surface upon which the furniture or appliance is placed.

In one embodiment, this invention is a furniture glide. The furniture glide includes a rod having a first end and a second end. A glide foot is attached to the rod second end and includes a threaded neck and a foot having a convex face. The furniture glide also includes a retractable glide cup including a central aperture, a first annular space having an inner surface and an outer surface wherein the inner surface includes grooves complementary to the threaded neck of the glide foot, and a second annular space that encompasses at least a portion of the glide foot.

In another embodiment, this invention is a furniture glide. The furniture glide includes a rod having a first end and a second end wherein the rod first end is threaded and wherein the rod second end is an anchor. The glide further includes a glide foot attached to the rod second end, the glide foot including a threaded neck and a foot having a convex face. The glide further includes a retractable glide cup including a central aperture, a first shoulder and a first wall portion forming a first annular space having an inner surface and an outer surface wherein the inner surface includes groves complementary to the threaded neck of the glide foot, and a second wall portion and second shoulder forming a second annular space that encompasses at least a portion of the glide foot.

DESCRIPTION OF THE CURRENT EMBODIMENT

Figure 1:
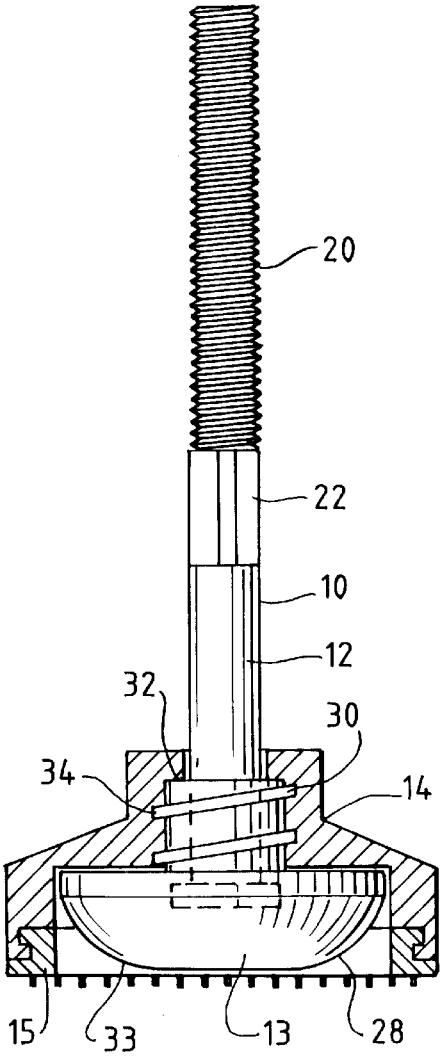
FIG. 1 is a side view of a glide assembly of this invention wherein the retractable glide cup is depicted in a side cutaway view.
Figure 2:
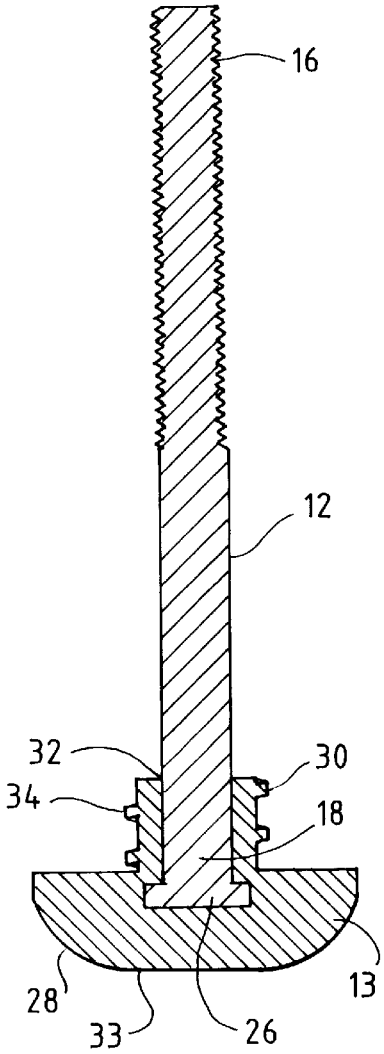
FIG. 2 is a side cutaway view of a portion of a glide of this invention including a rod and a glide foot.

The present invention relates to a glide that is useful in conjunction with modular or nonmodular furniture, household appliances and any other items that need to be leveled and immobilized. FIG. 1 is an embodiment of a glide 10 of this invention. Glide 10 includes a rod 12, a glide foot 13, a retractable glide cup 14 and a gripper 15. Referring to FIGS. 1–2, rod 12 includes first end 16 and second end 18. Rod first end 16 includes a mechanism for attaching the glide to the bottom of a piece of furniture or to an appliance. It is preferred that the attaching mechanism is threads 20 that are complementary to grooves associated with the furniture or appliance to which the glide is to be attached. The rod threads 20 allow the glide to be indexed axially towards or away from the furniture or appliance to which the glide is attached thereby facilitating leveling of furniture or appliances.

Rod 12 includes an optional gripping section 22. Gripping section 22 preferably consists of two or more parallel planar sections that can be gripped by a wrench, by channel grips or by any other gripping tool in order to rotate glide 10 with respect to the piece of furniture or the appliance to which it is attached. Rotating glide 10 engages or disengages the glide from the piece of furniture and in order to assist in leveling the piece of furniture or appliance by adjusting the glide length.

Rod 12 includes a second end 18. Rod second end 18 is encompassed by glide foot 13. It is preferred that rod second end 18 is irreversibly associated with glide foot 13. In order to facilitate the preferred irreversible union of rod second send 18 with glide foot 13, it is preferred that rod second end 18 include an anchor 26. Anchor 26 facilities the irreversible association of glide foot 13 to rod second end 24 when glide foot 13 is formed around anchor 26.

Figure 3:
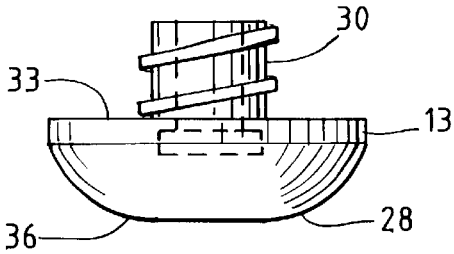
FIG. 3 is a glide foot that may be associated with a glide embodiment of this invention.
Figure 4A:
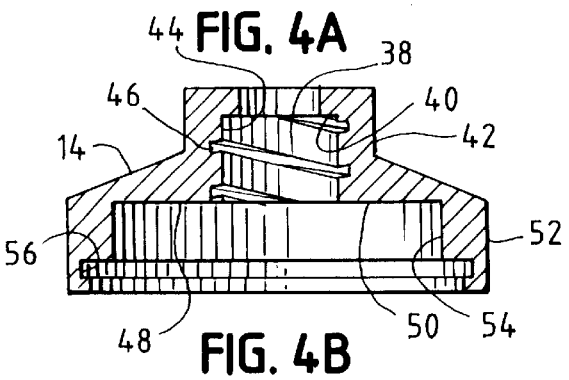
FIGS. 4A, 4B and 4C are a side cutaway view, a top view, and a bottom view of a retractable glide cup useful in conjunction with a glide embodiment of this invention.
Figure 4B:
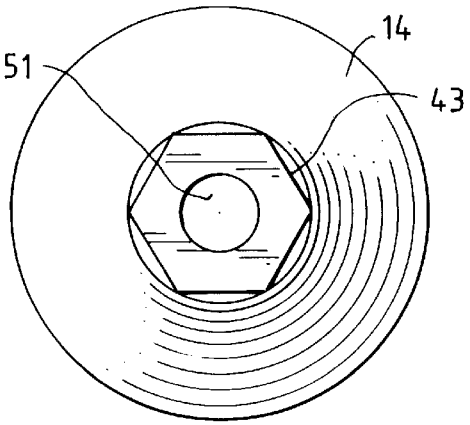
Figure 4C:
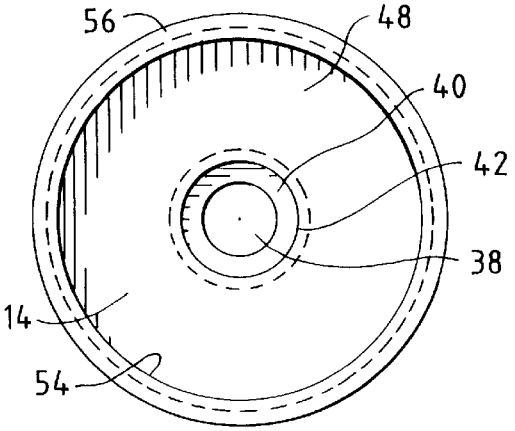
Figure 5A:
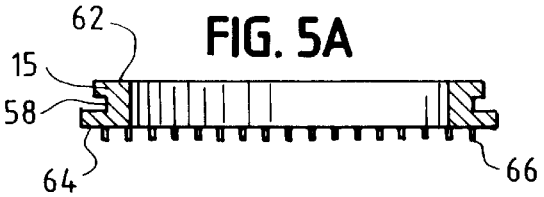
FIGS. 5A, 5B and 5C are a side cutaway view, a top view and a bottom view of a replaceable gripper useful in association with a glide embodiment of this invention.
Figure 5B:
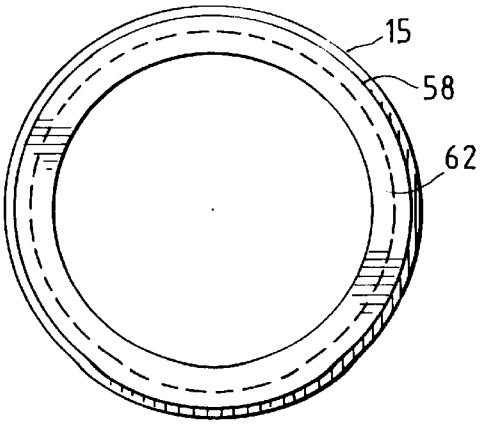
Figure 5C:
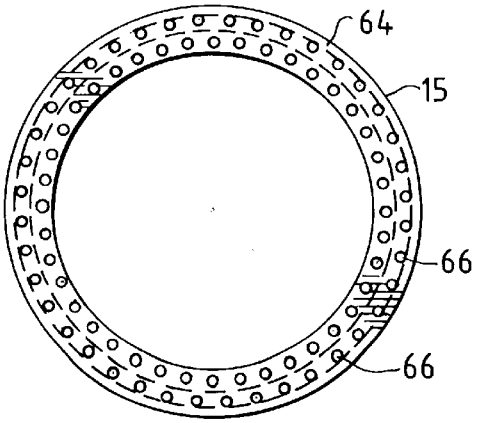

Referring now to FIGS. 1–3, glide 10 includes glide foot 13 associated with rod second end 18. Glide foot 13 further includes a foot 28 and a neck 30. Neck 30 is circular in shape and includes a first shelf 32 and threads 34 located on the outside face of neck 30 beginning at about first shelf 32 and terminating at about the point where neck 30 meets foot 28. Foot 28 includes a second shelf 33 and a convex pad 36. The convex pad 36 provides a smooth contact surface which allows the furniture or appliance to which glide 10 of this invention is associated to be moved easily across carpets and floors without lifting the appliance or piece of furniture.

Referring now to FIGS. 1 and 4A–4C, glide 10 of this invention includes a retractable glide cup 14 which is sized to fit over and "cup" glide foot 13. Retractable glide cup 14 includes a first annular space 38 which is formed by first shoulder 40 and first wall portion 42. First annular space further includes an inner wall portion 44 which includes grooves 46 which are complementary to threads 34 of glide foot neck 30. Retractable glide cup 14 also includes a second annular space 48 which is formed by a second shoulder 50 and second wall portion 52. Second annular space 48 is sized to be large enough to encompass foot 28 of glide foot 13. Retractable glide cup 14 further includes an aperture 51 which is slightly larger in diameter than the diameter of rod 12.

The height of second wall portion 52 may vary depending on whether glide 10 includes a gripper 15. If glide 10 does not include a gripper 15, then second wall portion 52 should have height sufficient to extend beyond the bottom of convex pad 36 of foot 28 when retractable glide cup 14 is fully engaged with glide foot 13. If glide 10 does include a gripper 15, then second wall portion 52 preferably has a height that is insufficient to extend beyond the bottom of convex pad 36 unless gripper 15 is associated with retractable glide cup 14. Retractable glide cup 14 may optionally include a nut shaped first wall portion 43. A nut-shaped first wall portion 43 provides a site which can be gripped with a tool in order to rotate retractable glide cup 14 with respect to rod 12 and glide foot 13.

Figure 6:
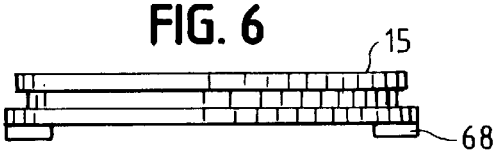
FIG. 6 is a side view of a replaceable gripper useful in association with a glide embodiment of this invention when the glide is associated with a piece of furniture or appliance that is to be placed on a hard surface.

Referring now to FIGS. 1, 4A–4C, 5A–5C and 6, glide 10 of this invention includes an optional gripper 15. If glide 10 includes an optional gripper 15, then retractable glide cup second wall portion inside face 54 will have a circumferential groove 56 that is complimentary to a circumferential slot 58 on the outer face of gripper 15. Gripper 15 will typically be made of a malleable material such as a rubber or a synthetic or plastic material which allows gripper 15 to be easily engaged and disengaged with circumferential groove 56 of retractable glide cup 14. Gripper 15 further includes a top 62 and a bottom 64. Bottom 64 of gripper 15 optionally includes a surface treatment which allows gripper 15 to remain in secure contact with the surface upon which the furniture or appliance is placed. One optional bottom surface treatment is a plurality of teeth 66. Teeth 66 are useful for gripping carpet to prevent a piece of furniture or an appliance from moving when glides 10 are level and stabilized. Another optional bottom surface treatment, as shown in FIG. 6, is a pad 68 that is manufactured of rubber or any other tacky material immobilizes the furniture or appliances when they are placed on concrete, tile, a computer floor and so forth.

FIG. 1 depicts a glide 10 of this invention as it would appear when engaged in a manner that stabilizes a piece of furniture or appliance to prevent it from being moved. In the stabilized position, retractable glide cup 14 is completely threaded on to neck 30 of glide cup 14 such that first shoulder 40 of retractable glide cup 14 stops on first shelf 32 on glide foot 13. In addition, if glide 10 includes an optional gripper 15, then gripper 15 will extend beyond the bottom convex pad 36 of foot 28 when retractable glide cup 14 is fully engaged with glide foot 13. This allows gripper 15 to bear at least a portion of the furniture or appliance weight and thereby inhibit the movement of the furniture or appliance to which glide 10 is associated.

In order to move a piece of furniture or an appliance to which glide 10 is associated, retractable glide cup 14 must be at least partially unthreaded from neck 30 of glide cup 13. Partially unthreading retractable glide cup 14 causes the furniture or appliance weight to be transferred from glide cup 14 or gripper 15 to convex pad 36 of glide foot 13. Convex pad 36 will typically be manufactured out of metal or hard plastic and it will have a smooth contact surface which can easily be moved across a hard surface or a soft surface such as carpet. Once the weight of the appliance or furniture rests upon convex pad 36, the furniture or appliance may be moved from one position to another without lifting the piece of furniture or appliance. Once the furniture piece or appliance has been relocated, retractable glide cup 14 is reengaged by fully threading retractable glide cup 14 into neck 30 of glide foot 13 thereby transferring at least a portion of the weight of the appliance or furniture piece to retractable glide cup 14 or upon optional gripper 15.

While specific embodiments of the invention have been illustrated and described herein, it is realized that modifications and changes will occur to those skilled in the art to which the invention pertains. It is therefore to be understood that the appended claims are intended to cover all such modifications and changes as followed in the true spirit and scope of the invention.

What we claim is:

1. A glide comprising:

a rod having a first end and a second end;

a glide foot attached to the rod second end, the glide foot including a threaded neck and a foot;

a retractable glide cup including a central aperture, a first annular space having an inner surface and an outer surface wherein the inner surface includes grooves complementary to the threaded neck of the glide foot, and a second annular space that encompasses at least a portion of the glide foot wherein the retractable glide cup has a bottom face including a circumferential groove; and a gripper including a circumferential slot that is associated with the retractable glide cup such that the gripper circumferential slot is associated with the glide cup bottom face circumferential groove.

2. The glide of claim 1 wherein the glide foot has a convex face.

3. The glide of claim 1 wherein the gripper includes a bottom face having a plurality of feet.

4. The glide of claim 1 wherein the gripper includes a bottom face having a circumferential pad.

5. The glide of claim 1 wherein the rod includes a gripping section.

6. The glide of claim 1 wherein the glide foot neck includes a nut shaped first wall section.

7. The glide of claim 1 wherein the rod second end is an anchor.

8. A glide comprising:

a rod having a first end and a second end wherein the rod first end is threaded and wherein the rod second end is an anchor;

a glide foot attached to the rod second end, the glide foot including a threaded neck and a foot having a convex face; and a retractable glide cup including a central aperture, a first shoulder and a first wall portion forming a first annular space having an inner surface and an outer surface wherein the inner surface includes grooves complementary to the threaded neck of the glide foot, and a second wall portion and second shoulder forming a second annular space that encompasses at least a portion of the glide foot.

9. The glide of claim 8 wherein the retractable glide cup has a bottom face including a circumferential groove, and wherein a removable gripper including a circumferential slot is associated with the retractable glide cup such that the gripper circumferential slot is associated with the glide cup bottom face groove.

10. The glide of claim 9 wherein the gripper includes a bottom face having a plurality of feet.

11. The glide of claim 9 wherein the gripper includes a bottom face having a circumferential pad.

* * * * *